US012514386B2

(12) United States Patent
Ulbricht

(10) Patent No.: US 12,514,386 B2
(45) Date of Patent: Jan. 6, 2026

(54) JEWELLERY BOARD

(71) Applicant: Michael Ulbricht, Egling (DE)

(72) Inventor: Michael Ulbricht, Egling (DE)

( * ) Notice: Subject to any disclaimer, the term of this patent is extended or adjusted under 35 U.S.C. 154(b) by 462 days.

(21) Appl. No.: 17/441,579

(22) PCT Filed: Mar. 10, 2020

(86) PCT No.: PCT/EP2020/056375
§ 371 (c)(1),
(2) Date: Sep. 21, 2021

(87) PCT Pub. No.: WO2020/200667
PCT Pub. Date: Oct. 8, 2020

(65) Prior Publication Data

US 2022/0167759 A1 Jun. 2, 2022

(30) Foreign Application Priority Data

Apr. 2, 2019 (DE) ..... 10 2019 108 615.9

(51) Int. Cl.
*A47F 5/08* (2006.01)
*A47F 7/02* (2006.01)

(52) U.S. Cl.
CPC ..... *A47F 5/0815* (2013.01); *A47F 7/02* (2013.01)

(58) Field of Classification Search
CPC ..... A47F 5/0815; A47F 5/00884; A47F 7/02; A45C 11/16; A47G 29/08
USPC ..... 206/566, 6.1, 482, 486, 495, 493, 526, 206/465; 211/85.2, 113; 248/220.31, 248/304, 223.41, 911, 222.12, 220.42, 248/225.11; 40/124.4, 661.03
See application file for complete search history.

(56) References Cited

U.S. PATENT DOCUMENTS 1,140,940 A * 5/1915 Bales ..... A47B 96/068 248/222.52
1,496,542 A * 6/1924 Jersemann ..... A47F 7/02 206/480

(Continued)

FOREIGN PATENT DOCUMENTS

CA 2106169 A1 3/1995
CN 2755710 Y 2/2006

(Continued)

OTHER PUBLICATIONS

International Search Report issued in PCT/EP2020/056375; mailed Jun. 17, 2020.

*Primary Examiner* — Orlando E Aviles
*Assistant Examiner* — Brijesh V. Patel
(74) *Attorney, Agent, or Firm* — Studebaker Brackett PLLC

(57) ABSTRACT

A board is configured as a jewellery board (1; 2; 3) for arranging and storing items of jewellery such as necklaces, decorative bands or rings, and includes a number of cutouts (16) which penetrate through the board (10; 40; 50) with retainers (26) integrated therein for detachable fastening of the respective items of jewellery to the board, a pin-like projection (26) as a retainer which projects upwards into the cutout in the lower region of each cutout (16), and a spacer (12; 44; 52) of the board (10; 40; 50) for maintaining a free space (A; a) on a rear side (18; 48; 56) of the board (10; 40; 50) at least in the region of the cutouts (16).

19 Claims, 3 Drawing Sheets

(56) References Cited

Figure 1:
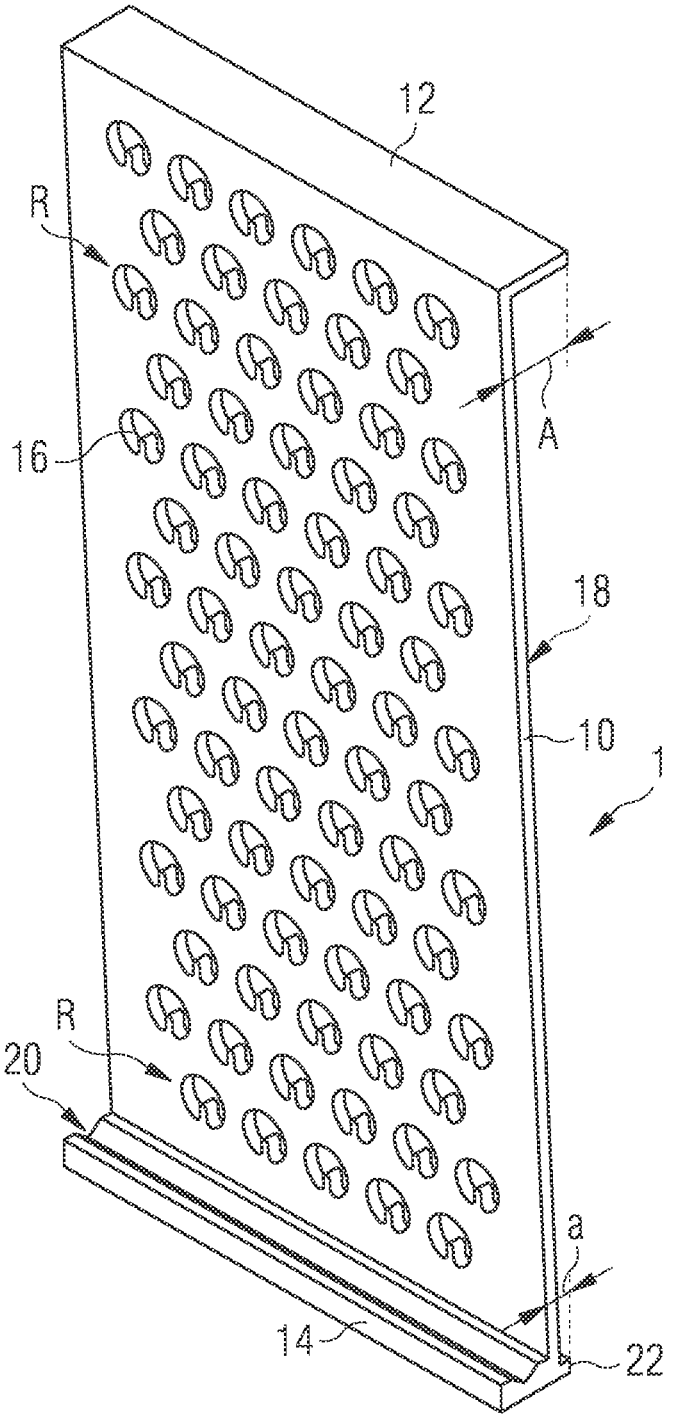

U.S. PATENT DOCUMENTS 1,729,249 A * 9/1929 Egan ..... G09F 3/20 40/651
2,119,832 A * 6/1938 Schless ..... A47F 7/02 206/565
2,288,706 A * 7/1942 Herr ..... A47G 1/1633 47/41.01
2,316,892 A * 4/1943 Saul, Jr. ..... A47F 5/0025 248/125.3
D137,945 S * 5/1944 Geller ..... D6/311
D159,997 S * 9/1950 Mapson ..... D6/682.2
2,579,704 A * 12/1951 Saul, Jr. ..... A47F 5/0025 108/147.11
2,595,463 A * 5/1952 Kamps ..... A01K 97/16 43/57.2
2,627,276 A * 2/1953 Eggleton ..... G04D 3/083 215/390
3,135,389 A * 6/1964 Farley ..... A47G 25/005 211/115
3,204,774 A * 9/1965 Barbieri ..... A47F 7/024 206/562
3,310,271 A * 3/1967 King ..... A47F 5/0815 248/222.52
3,642,147 A * 2/1972 Voorhies ..... F16B 45/00 118/500
D228,998 S * 11/1973 Rozman ..... D6/310
3,850,396 A 11/1974 Orlandi
4,074,637 A * 2/1978 Lorenzen, Jr. ..... A47F 7/024 116/75
D248,801 S * 8/1978 Tafoya ..... D6/682.2
4,141,453 A * 2/1979 Hanan ..... A47F 5/02 211/85.2
D251,645 S 4/1979 Kelly
D252,899 S * 9/1979 Campbell ..... D6/682.2
4,175,602 A * 11/1979 Cavalaris ..... A45C 3/00 141/390
4,175,660 A * 11/1979 Feibelman ..... B65D 73/00 206/468
4,240,684 A * 12/1980 Henning ..... B25H 3/04 312/215
4,312,449 A * 1/1982 Kinderman ..... A47F 5/0884 206/466
D269,145 S * 5/1983 Druiz ..... 211/85.2
D270,712 S * 9/1983 Triangolo ..... D9/457
4,406,372 A * 9/1983 Bell ..... A47F 7/024 206/565
4,420,084 A * 12/1983 Whelan ..... A47F 7/02 211/85.2
4,434,960 A * 3/1984 Berry ..... A47F 5/0815 248/223.31
4,454,949 A * 6/1984 Flum ..... A47F 3/0486 206/563
4,483,502 A * 11/1984 Fast ..... A47F 5/0068 248/223.41
4,492,169 A * 1/1985 Ware ..... A47B 57/045 D6/705.6
4,550,839 A * 11/1985 Good ..... A47G 33/06 248/220.31
4,629,100 A * 12/1986 Owens ..... D04D 7/10 223/46
4,646,920 A * 3/1987 Kruger ..... A47F 7/02 211/85.2
4,718,627 A * 1/1988 Fast ..... G09F 3/204 248/222.12
4,739,886 A * 4/1988 Seaberg ..... A47F 7/02 211/85.2
4,775,053 A * 10/1988 Geiger ..... A47F 7/02 211/85.2
4,872,963 A * 10/1989 Van Horn ..... C25D 17/08 118/503
D304,533 S * 11/1989 Campbell ..... D6/682.2
D304,793 S * 11/1989 Burke ..... D6/569
D309,252 S * 7/1990 Crowley ..... D8/373
4,979,711 A * 12/1990 McIlroy ..... A47F 5/0006 248/214
D317,095 S * 5/1991 Albers ..... D6/678.4
5,026,011 A * 6/1991 Hoefkes ..... A47F 5/0823 248/220.41
5,033,625 A * 7/1991 Campbell ..... A47F 7/02 211/85.2
D319,749 S * 9/1991 McPherson ..... D6/567
5,054,624 A * 10/1991 Camp ..... A47F 5/02 211/85.2
5,067,617 A * 11/1991 Caldwell ..... A47F 7/02 211/85.2
D328,681 S * 8/1992 Radosevich ..... D6/567
5,160,049 A * 11/1992 McMillen, Jr. ..... A47F 7/02 211/85.2
5,163,567 A * 11/1992 Betts, Sr. ..... A47L 15/505 211/75
D333,390 S * 2/1993 McCauley ..... D6/690
D338,117 S * 8/1993 Caldwell ..... D6/682.2
5,240,120 A * 8/1993 McDonough ..... A47F 7/02 211/85.2
D343,592 S * 1/1994 Vernon ..... D6/682.2
5,284,259 A * 2/1994 Conway ..... A47F 5/0006 248/225.11
5,339,967 A * 8/1994 Valiulis ..... A47F 5/0006 211/113
5,346,167 A * 9/1994 Smialek ..... A47F 5/0823 248/222.13
5,386,916 A * 2/1995 Valiulis ..... A47F 5/0056 211/113
5,490,650 A * 2/1996 Pendergrass ..... A47F 5/0823 248/303
5,531,415 A * 7/1996 Kallemeyn ..... B25H 3/04 248/220.31
5,547,072 A * 8/1996 Kaiser ..... B65D 43/24 206/6.1
5,671,849 A * 9/1997 Bacon ..... A47G 1/12 211/85.2
5,685,436 A * 11/1997 Davet ..... A47F 7/024 211/85.5
D394,291 S * 5/1998 Beltran ..... D6/552
5,913,417 A * 6/1999 Ovadia ..... A47F 7/02 206/6.1
5,915,571 A * 6/1999 Czalkiewicz ..... A47F 7/145 211/128.1
5,950,815 A * 9/1999 Yetman-Bellows ... A47G 1/143 211/85.2
5,957,274 A * 9/1999 Ovadia ..... A47F 7/02 206/493
6,202,865 B1 * 3/2001 Kuo ..... A47F 5/0815 211/70.6
6,205,688 B1 * 3/2001 Grosser-Samuels ..... G09F 5/00 40/124.06
6,571,597 B1 * 6/2003 Tucker ..... F16L 3/123 29/897.2
D478,233 S * 8/2003 Chaney ..... D6/552
6,726,037 B2 * 4/2004 Chandaria ..... A47F 5/0807 40/124.4
6,758,330 B1 * 7/2004 Chudada ..... A47F 7/02 206/459.5
6,866,143 B2 * 3/2005 Ovadia ..... A47F 7/02 206/6.1
6,918,498 B2 * 7/2005 Sparkowski ..... A47F 5/13 211/187
6,932,212 B2 * 8/2005 Ovadia ..... A47F 7/02 211/85.2
6,966,446 B1 * 11/2005 Wise ..... A47F 5/0006 211/113
D517,910 S * 3/2006 Bonnell ..... D6/661.2
7,008,029 B1 * 3/2006 Aclin ..... A47B 67/02 312/227
D537,276 S * 2/2007 Kelman ..... D6/682.2
7,175,019 B2 * 2/2007 Beal ..... A45C 11/16 40/124.06
D591,085 S * 4/2009 Burns ..... D6/681.1
D612,288 S * 3/2010 Finneseth ..... D11/132

(56) References Cited

U.S. PATENT DOCUMENTS

| | | | | | |
|---|---|---|---|---|---|
| D620,728 | S * | 8/2010 | Snider | A47J 47/16 | D7/600.1 |
| D622,079 | S * | 8/2010 | Stukenberg | D6/682.4 | |
| D683,914 | S * | 6/2013 | Jones | D30/121 | |
| 8,607,970 | B2 * | 12/2013 | De Lecce | A47F 7/024 | 211/85.2 |
| D749,775 | S * | 2/2016 | Provitola | D26/118 | |
| D751,844 | S * | 3/2016 | Hjartardottir | D6/682.4 | |
| 9,357,859 | B2 * | 6/2016 | Fanning, Jr. | A47F 7/0042 | |
| 9,532,663 | B2 * | 1/2017 | Nilsson | B25H 3/04 | |
| 10,085,572 | B2 * | 10/2018 | Simone | A47F 5/13 | |
| 10,405,651 | B1 * | 9/2019 | Kramer | A47B 57/34 | |
| 10,405,676 | B1 * | 9/2019 | Underwood | A47F 5/0846 | |
| 10,477,991 | B1 * | 11/2019 | Fragala | A47F 7/02 | |
| D900,517 | S * | 11/2020 | Smith | D6/682.1 | |
| D916,535 | S * | 4/2021 | Mortensen | D6/672 | |
| 2006/0081548 | A1 * | 4/2006 | Babbino | A47F 7/021 | 211/85.1 |
| 2010/0326934 | A1 * | 12/2010 | Goldberg | A47F 7/024 | 211/85.2 |
| 2013/0026119 | A1 | 1/2013 | Barron | | |
| 2015/0068993 | A1 * | 3/2015 | Ye | A45C 13/123 | 211/85.2 |

FOREIGN PATENT DOCUMENTS

| | | | | | |
|---|---|---|---|---|---|
| CN | 102406414 | A | | 4/2012 | |
| CN | 206738899 | U | | 12/2017 | |
| CN | 207444713 | U | | 6/2018 | |
| DE | 29513756 | U1 | | 10/1995 | |
| DE | 19606285 | A1 | * | 9/1996 | A47F 7/02 |
| DE | 202011005126 | U1 | | 8/2011 | |
| DE | 102012102805 | A1 | | 10/2013 | |
| GB | 1589963 | A | * | 5/1981 | B65D 25/22 |
| GB | 2061104 | A | * | 5/1981 | A47F 7/02 |
| GB | 2271715 | A | * | 4/1994 | A47F 7/02 |
| GB | 2518416 | A | | 3/2015 | |
| WO | 2005/120309 | A1 | | 12/2005 | |

* cited by examiner

JEWELLERY BOARD

The invention relates to a device for clear storage of jewellery or a board which is configured as a jewellery board for arranging and storing items of jewellery such as bracelets and necklaces, decorative bands, rings and the like.

DE 20 2011 005 126 U1 relates to a surface element consisting of a receiving device for items of daily use, in particular for (jewellery) items configured differently to one another, comprising undercut or hook elements for this items, wherein said device including all undercut and hook elements is formed from a single surface element into which various material cutouts are introduced. The surface element makes a very technical impression and therefore used or unused does not afford any absolutely appealing view. In addition, it cannot be used very flexibly since specific receiving devices are only suitable for specific jewellery items.

DE 10 2012 102 805 A1 describes a jewellery board for storing a plurality of different items of jewellery. In order that the items of jewellery can be stored in a clear arrangement for home use so that a removal during use and re-storage after use do not require any expensive search work, the invention provides that the jewellery board is configured as a board and is fastened to a vertical wall, preferably the inside of a cupboard door and that at least one horizontal row of hooks for suspending chains and similar items of jewellery and at least one horizontally arranged receiving container which is open at the top are attached on the exposed side of the board wherein at least two juxtaposed foam blocks are introduced into the receiving container between which rings, earrings and similar items of jewellery can be inserted. Manufacture of the jewellery board proves to be comparatively complex and therefore relatively expensive.

It is therefore the object of the invention to provide a convenient-to-use device for clear storage of jewellery which affords an aesthetically pleasing design and which can be manufactured cost-effectively.

This object is achieved with a board of the type mentioned initially whereby it is provided with a number of cutouts which penetrate through the board with retaining means arranged therein for detachable fastening of the respective items of jewellery to the board, wherein a pin-like projection which projects upwards into the cutout in the lower region of each cutout is configured as retaining means and the board has a rear-side spacer for maintaining a free space on a rear side of the board at least in the region of the cutouts.

The board configured as a jewellery board or its plane of extension can be positioned largely vertically for its use as intended, for example, suspended on a wall or placed largely upright in order that the items of jewellery can be arranged next to one another and above one another on the board. The largely vertical alignment of the board plane gives the items of jewellery, in particular chains, bands and the like a matching alignment under the action of gravity without assistance of the user.

Each cutout can be assigned precisely one retaining means. A plurality of cutouts then makes it possible to receive a number of items of jewellery on the board which are the same size or approximately the same size. Thus, the number of cutouts can determine the receiving capacity of the board as a storage device for items of jewellery. Alternatively a cutout can provide a plurality of retaining means. A 1:1 assignment of retaining means and cutouts is therefore not compulsory so that not the number of cutouts but the number of retaining means can define the capacity of the board. A high receiving capacity can then also be achieved with one, two or few cutouts or a plurality of cutouts. If a cutout contains a plurality of retaining means, the cutout is then usually configured to be horizontal in format or with a greater extension in the transverse direction than in the vertical direction in the plane of the board and usually receives the plurality of retaining means next to one another. In the following however, for the sake of simplicity, an assignment of precisely one retaining means to precisely one cutout is usually assumed even if other assignments are not intended to be excluded thereby.

The configuration of the cutouts as openings in the board makes not only the front side usable for the user for storage but in particular also, albeit to a lesser extent, the rear side of the board which is concealed per se. This is because conventional hook boards such as are known, for example, from the above DE 10 2012 102 805 A1 or boards with receiving pockets such as the subject matter of US 2013 0026 119 A1 only utilize the potential of a board as storage site on one side without using the material thickness of the board itself and its rear side. In addition, the configuration of the cutouts as openings makes them relatively easy to manufacture by drilling, milling, laser cutting or the like depending on the material of the board but does not exclude other possibilities for manufacture such as, for example, mould casting.

In each case at least one retaining means for detachable fastening of at least one item of jewellery on the board is arranged in each of the cutouts. Thus, each cutout affords one fastening possibility in each case. In this case, one cutout is not necessarily assigned to precisely one item of jewellery for storage on the board. For example, a plurality of rings in one cutout or a chain in several cutouts can be fastened detachably on one retaining means.

According to the invention, a pin-like projection projecting upwards into the cutout is configured as retaining means in the lower region of each cutout. The lower region of the cutout can be defined by reference to the alignment of the board as that region of the cutout which lies closest to a lower edge of the board, for example, its contact surface. From that lower region, in particular from a lower edge of the cutout, the pin-like projection projects upwards, namely contrary to the force of gravity without protruding from the board. Expediently it extends in the plane of extension of the board.

A projection which is configured as a frequently cylindrical or rectangular continuation of a component which serves to connect the component to another component is to be understood as pin-like. In the present case, the projection connects the board to an item of jewellery and specifically using the action of gravity on the item of jewellery. Gravity ensures that the item of jewellery, once suspended, remains on the erected projection. The projection and optionally the cutout additionally prevent an undesired lateral displacement of the item of jewellery. The invention uses the finding that merely a simple pin-like projection is required in order to store quite different types of objects or items of jewellery such as rings, chains, bands and the like on the board.

The board according to the invention additionally has at least one spacer for maintaining a free space on a rear side of the board at least in the region of the cutouts. Said spacer is usually arranged at the back and can be configured in a punctuate manner, for example, as a single pin or linearly, for example, as a strip. In each case, the spacer creates an operating space which makes it easier for a user to bring an item of jewellery in sections onto the projection or when viewed from the user, behind the projection. The invention specifically starts from the finding that a convenient fastening of an item of jewellery on the board is achieved whereby the projection is also accessible on its rear side at least in a depth corresponding to the width of the item of jewellery to be fastened. The spacer specifically prevents an item of jewellery not being placed on the projection when a wall surface located behind abuts directly against the rear side of the board or against a projection. The spacer therefore merely facilitates or enables the successful and convenient fastening of an item of jewellery on the board.

According to an advantageous embodiment of the invention, the board or its plane of extension can have an inclination with respect to the perpendicular in the vertical direction. The inclination can fundamentally point in both directions so that a user side of the board when viewed in a direction from its underside to its upper side can be inclined towards the user or away from the user. The inclination can on the one hand ensure the spacing explained above from a wall surface or the like when the board is suspended. This is because even if said board rests with a lower edge on the wall surface, a sufficient spacing can remain in the region of the cutouts when the cutouts maintain a suitable spacing from the lower edge. The spacing from the lower edge is obtained in any case for constructive or visual reasons. On the other hand, the inclination can ensure a defined position of the items of jewellery on the board or on its user side, namely on the side of the board facing the user. In the case of an inclination of an upper side of the board towards the user, in particular suspended chains or bands can maintain a distance from the user side of the board with the result that on the one hand, they hang straight downwards due to gravity without resting on other items of jewellery even when these items overlap them when seen in one viewing direction. Thus, the arrangement in particular of elongated items of jewellery such as chains or bands acquires an aligned formation which leaves a visually more pleasant, namely orderly impression. An inclination in the opposite direction, namely in an upper region of the board inclined away from the user on the other hand can ensure that suspended elongated items of jewellery usually maintain their position once selected and do not unintentionally lose it due to gusts of wind or the like because they can rest on the user side of the board. In addition, with this inclination an illumination of the items of jewellery, for example, for presentation purposes can be more favourable because the items of jewellery cannot shade themselves in any case when an illumination is usually incident from an upper side.

In order to maintain the inclination, the board has an inclining device. As such, a suspendable board can have a rear-side spacer already mentioned above which however supports only the upper or only the lower edge of the board on a wall surface at a distance. With a spacer attached to the upper side, the board can be fastened to a wall surface, a door or the like with a distance at the top. If there is no lower-side spacer, the board then has an inclination directed in a direction upwards towards the user. An oppositely directed inclination of the board can then be achieved with an upper-side fastening and a lower spacer on the board. The only upper-side or only lower-side spacer then forms the aforesaid inclining device.

A board which can usually be set up with its lower edge can maintain its inclination through a suitable support between the contact surface of its lower edge and its upper region. In a simple embodiment the inclining device of an erectable board can consist of a rod which is fastened in an upper region of the board, for example, by inserting into a blind hole at an angle with respect to the plane of extension of the board and which can be placed with the lower edge of the board on the same. In the case of a very steep angle of inclination of the board close to the perpendicular, at least one rod in a lower region of the board can be fastened in the board at an angle close to or precisely at right angles. The inclination of the board is obtained in a direction when viewed from bottom to top towards the user on that side of the board on which the support is arranged. The support then at the same time forms the inclining device. Alternatively the inclination of the board can also be achieved whereby it is clamped with its lower edge in a base inclined in one or the other direction of inclination.

In particular, an upper-side spacer can furthermore and advantageously be combined functionally with a suitable suspension device so that only a single device is required to achieve a spacing on the one hand and for suspension of the board on a wall surface on the other hand. Fundamentally the board can have openings for suspension on screws, screw hooks, nails, cable devices or the like. Advantageously in an upper region the board can have fastening means configured integrally therewith such as, for example, space-forming suspension hooks or such a suspension strip. A suspension strip as a linear suspension device can protrude from the board on the rear side like a flange and at the same time as a plurality of fastening possibilities can define an upper-side spacing of the board.

According to a further advantageous embodiment of the invention, the board can have respectively one angular strip on an upper and a lower edge which protrude on different sides, namely opposite to the plane of extension of the board. At the upper edge the angular strip attached to the board on the rear side can be a spacer, also an inclining device if there is no lower spacer and at the same time a suspension device; the lower angular strip which faces the user can be a support for rings, earrings etc. Despite their configuration being preferably the same, the angular strips thus fulfil a different purpose. With an identical configuration they give the board a calm and pleasing side view.

The cutouts can fundamentally be placed in an arbitrary arrangement on the board. According to a further advantageous embodiment of the invention, the cutouts can be arranged in horizontal and/or vertical rows above and/or next to one another. In addition to an optimized surface usage of the board, a pleasing "orderly" appearance can be obtained.

The cutouts can basically have a border in any outline shape. Usually they have a rectangular or square shape but can for example also be hexagonal and therefore, for example, form a honeycomb pattern on the board, they can be configured to be octagonal or even diamond-shaped, for example, in order to thus produce a regional reference. Preferably the cutouts can have a substantially circular border, i.e. a circular edge. Thus, a pleasing design can be achieved with each board shape, i.e. regardless of whether the board itself is rectangular, square, irregularly angular or round, oval or circular.

As long as the cutouts and the retaining means arranged therein are configured according to the same principle and therefore enable easy handling, they can have almost arbitrary outline shapes within a board. Preferably however the cutouts together with retaining means of a board can be configured to be of the same type and in particular identical. Cutouts of the same type and their retaining means certainly have the same shape and mutually corresponding proportions but have different dimensions. Thus, one cutout can be a reduction in size or enlargement of the adjacent cutout. The different-sized cutouts and retaining means can then be arranged on the board sorted, for example, according to size so that for example, the larger cutouts are arranged on the outside and the smaller ones on the inside. The cutouts and their retaining means are identical if they have the same dimensions in addition to the same shape and identical proportions. Their arrangement can produce a uniform "calm" design of the board which when not in use or unused regions thereof act as a decorative pattern. In addition, they can offer easier manufacture.

In particular the retaining means themselves serve for detachable fastening of an item of jewellery on the board. They can be specially adapted for this purpose and inserted in the cutout. According to a further advantageous embodiment of the invention, the board can have retaining means configured integrally with the board. In particular, when producing the retaining means in a joint process step together with the cutouts, they can thus be produced particularly cost-effectively. Thus, the retaining means can be worked out from the board material itself, for example, by cutting out, sawing or laser cutting. An integral configuration of the retaining means can furthermore be achieved for example also by mould casting. In addition to the simple and cost-effective manufacture, despite the large number of retaining means the board affords a particularly simple impression because of the lack of component edges between the retaining means on the one hand and the board on the other hand.

As explained above, the spacer provides for a good rear-side accessibility of the retaining means so that an item of jewellery can be placed thereon conveniently and successfully. On the other hand, the retaining means must hold the items of jewellery reliably on the board. According to a further advantageous embodiment of the invention, the board can therefore have a T-shaped pin-shaped projection as retaining means. The T-shaped retaining means can therefore offer a better hold for bulky items of jewellery, for example, large rings or stiffer leather bands. The T-shaped retaining means can fundamentally be configured like a nail with a head projecting over its shaft. Preferably however it lies completely within the plane of the board because the T-shaped retaining means can then be manufactured more easily.

Alternatively or additionally the retaining means can have a notch or recess incorporated on the rear side, in particular a horizontal groove. This can be produced easily, does not impair the user-side appearance of the board and nevertheless gives the items of jewellery a better hold.

The cutouts in the board inter alia have the purpose of opening an operating space around the retaining means for placement or pushing on of an item of jewellery. According to an advantageous embodiment of the invention, a viewing surface of the retaining means can therefore occupy a maximum of a quarter or a fifth of the area of the cutout to be assumed without retaining means. The area of the cutout to be assumed without retaining means is that area which the cutout would occupy according to its basic shape without arrangement of the retaining means, i.e. an in this respect "undisturbed", for example, square, rectangular, diamond-shaped, oval, circular or other area. With a fraction of the retaining means of a quarter or a fifth of the area of the cutout, a sufficient operating space is ensured around the retaining means which allows a convenient and at all times successful fastening of an item of jewellery to the board. As long as the retaining means can reliably fulfil its function, the area occupied by the retaining means inside the cutout can naturally also be smaller. Tests have shown that even ratios of 1/8, 1/10, 1/12, 1/15 as far as a ratio of 1/19 can be suitable, in each case depending on the basic shape of the cutout.

In addition to the area ratio that the area of the cutout to be assumed without retaining means on the one hand and the area of the retaining means on the other hand can adopt with respect to one another in a viewing surface of the board, the amount by which the retaining means projects into the cutout can also influence the convenience and the success of the handling. According to a further advantageous embodiment of the invention, the pin-shaped retaining means therefore extend from a lower edge of the cutout as far as at most two thirds of the height thereof. Even with these dimensions of cutout and retaining means, a convenient handling, namely a simple placement and removal of the item of jewellery can be achieved. With an extension of the retaining means up to about half the height of the cutout, a harmonious design of cutout and retaining means can also be achieved.

If there should be delicate items of jewellery which cannot be suspended on the pin-shaped retaining means, a further advantageous embodiment of the invention can comprise at least one separately configured suspension aid for jewellery which can be placed on a retaining means which comprises a ring portion for placement on the retaining means and a hook portion for suspending the jewellery. The delicate item of jewellery can thus be fastened indirectly on the board. For this purpose, the suspension aid is initially fastened to the board by placing it, like a piece of jewellery, with its ring portion onto the retaining means. For this purpose the ring portion does not need to comprise a geometrically closed ring but merely needs to be configured to be suspended on the retaining means. For this purpose, it can, for example, also be designed to be U-shaped and have respectively one hook portion at the free ends of the U legs. After placing the suspension aid on the retaining means, the piece of jewellery can then be fastened on the hook portion of the suspension aid.

According to a further advantageous configuration of the invention, the board can be configured to serve as a suspension device for textiles such as, for example, for tea towels or hand towels or for items of clothing such as jackets, coats, trousers or skirts. With fundamentally the same structure of the cutouts and the retaining means attached therein, a usually larger space requirement for handling thereof needs to be taken into account when dimensioning these. This is because hanging loops in particular of coats or heavy jackets are frequently thicker than delicate items of jewellery. Also the fingers of the male user's hands which are then relevant in any case can require a large space requirement than the usually more slender fingers of female jewellery wearers. The dimensioning of the retaining means should then be adapted to the usually higher loading by textiles.

As a hanging device, the board can be attached like a conventional cloakroom device to a largely perpendicular wall or to a door and extend predominantly horizontally. Said board can have one or a few rows with cutouts arranged above one another, next to one another which can preferably be arranged offset to one another in the transverse direction. The board can also have only one or a few cutouts next to one another which however each offer several retaining means.

Figure 2:
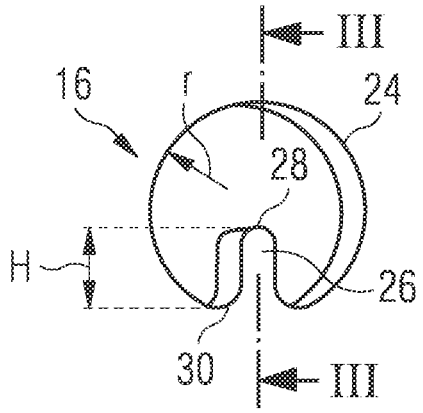
Figure 3:
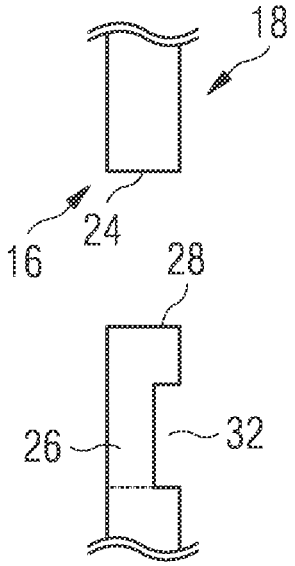
Figure 4:
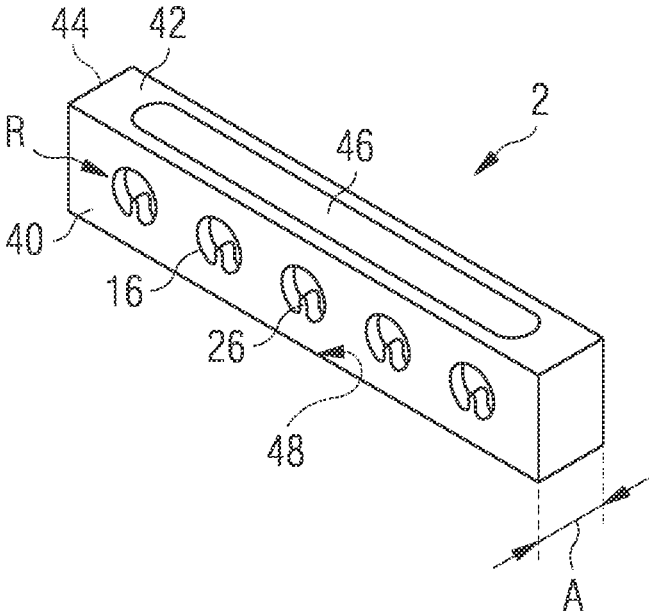
Figure 5:
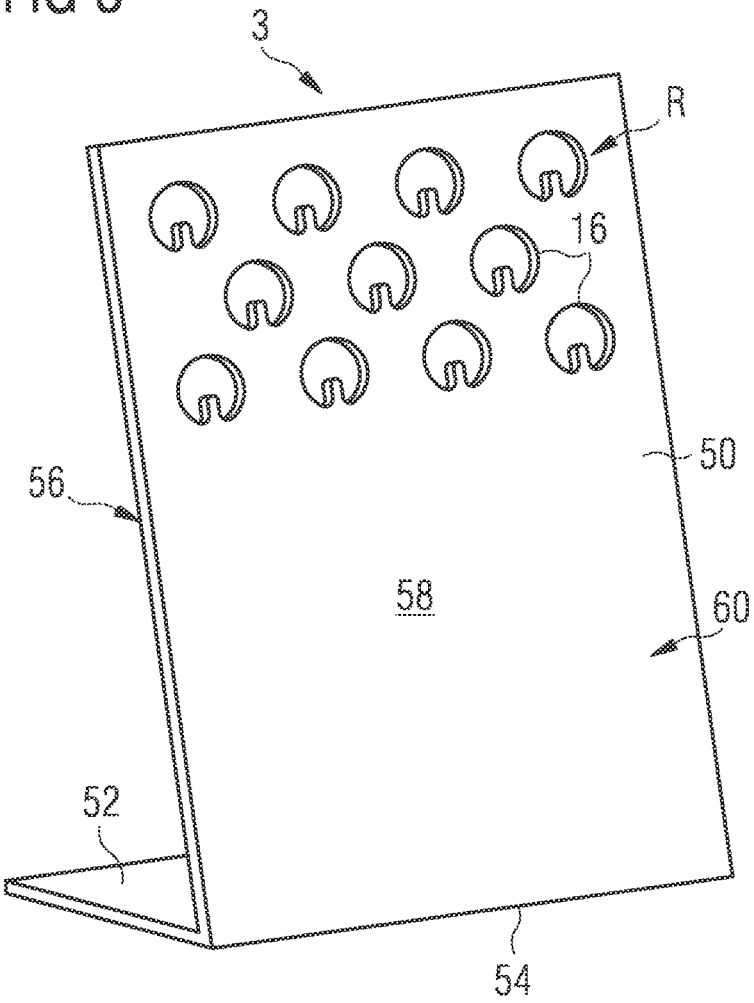
Figure 6:
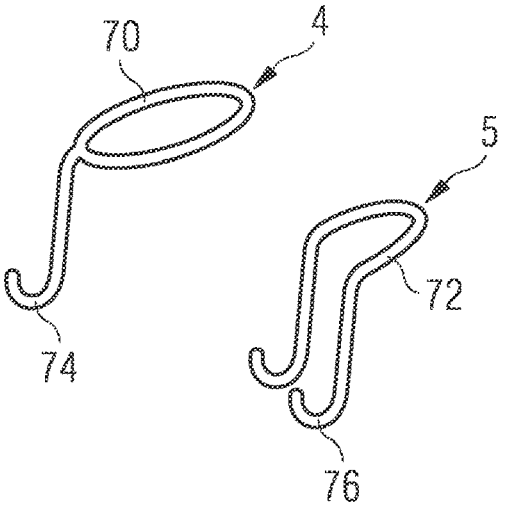

The principle of the invention will be explained in further detail in the following with reference to a drawing as an example. In the drawing:

FIG. 1: shows a perspective front view of a first embodiment of a jewellery board according to the invention, FIG. 2: shows a detailed view of an opening, FIG. 3: shows a sectional view according to the line of intersection III-III in FIG. 2, FIG. 4: shows a perspective front view of a second embodiment of a jewellery board according to the invention, FIG. 5: shows a perspective front view of a third embodiment of a jewellery board according to the invention, and FIG. 6: shows an embodiment of a suspension aid.

FIG. 1 shows a perspective front view of a first embodiment of the jewellery board 1 according to the invention. Said jewellery board is composed of a rectangular board 10, a continuous first flange 12 which protrudes towards the back at the top and a second flange 14 which is also continuous and protrudes substantially towards the front at the bottom. The board 10 contains seventy seven circularly bordered openings 16 as cutouts which are arranged in fourteen rows R with alternately five or six items per row and thus are offset with respect to one another from row to row. This results in a uniform and visually pleasant pattern of openings 16 on the board 10.

The first flange 12 and the second flange 14 run substantially parallel to one another. They do not protrude perpendicularly but at an angle of somewhat less than 90° and in the opposite directions from the board 10. The first flange 12 has a usually rectangular cross-section with a thickness corresponding to the thickness of the board 10 and on its underside has blind holes not shown as fastening aids into which for example, screw hooks can engage which are screwed onto a wall not shown for fastening the jewellery board. In addition the first flange 12 provides for a spacing A, which decreases towards the bottom, of a board rear side 18 from a wall located therebehind as soon as the jewellery board 1 was suspended as intended.

The second flange 14 is dimensioned to be thicker than the board 10 and has a V-shaped groove 20 on the upper side for placing small items of jewellery. On the rear side 18 of the board 10 said flange is continued in a flat strip 22 which ensures a minimal spacing a with respect to a vertical wall even at the lowest row R. Instead, the board 10 could also be configured to be extended downwards in one direction in order to bring about the same spacing a there.

The first flange 12 constitutes both a fastening means and also, combined with the second flange 14, an inclining device of the jewellery board 1 because the jewellery board 1 can only be suspended in an inclined manner at a vertical wall. It can thus only be suspended in a direction inclined upwards towards the user. Longer items of jewellery such as necklaces or decorative bands, optionally with pendants, which are fastened to the jewellery board 1, thus also obtain a spacing from the jewellery board 1 which increases in a direction downwards. Thus, longer items of jewellery do not rest on the jewellery board 1 and on the other items of jewellery fastened thereunder in the rows R with the result that a mutual entangling is eliminated. The jewellery board 1 consequently offers not only a clear and visually appealing possibility for storage for items of jewellery but also their convenient handling.

FIG. 2 shows a detailed view of an opening 16. This has a circular outline 24 with a radius r. From the lowest point of the outline 24 a pin 26 as retaining means projects radially upwards into the opening 16 and specifically up to about half to about the height of the centre point of the opening 16. A height H of the pin 16 can therefore approximately correspond to the radius r of the opening 16 or remain below this. The pin 26 has a rounded head 28 at the top with the result that it is designed particularly pleasingly. The roundings 30 with which the pin 26 goes over into the outline 24 in the base section serve for a visually pleasing design.

FIG. 3 shows a sectional view according to the line of intersection III-III in FIG. 2, i.e. perpendicularly through the pin 26 and orthogonally to the plane of extension of the board 10. It can be seen therein that the pin 26 has a notch 32 on the rear side 18 of the board 10 which begins approximately in its base section at the transition to the outline 24 and extends as far as below the head 28. It can thus be achieved that items of jewellery which have been placed on the pin 26 do not slip off again from the pin 26 and drop down, for example, as a result of a certain stiffness and their weight. If these items lie in the notch 32, they can be prevented from any undesired slipping off. Alternatively the pin 26 can have at least the thickness of the board 10 over its ensure height H and can be configured to be thicker at its head 28 on the rear side so that the thickened head projects over the plane of the rear side 18.

The jewellery board 1 can therefore be fastened to a largely perpendicular wall at the first flange 12. As a result of its greater spacing A in the region of the first flange 12 and its smaller spacing a in the region of the second flange 14, the rear side 18 maintains a spacing from the wall over the entire area of the board 10 and does not rest on the wall. Thus, the pins 26 also remain accessible on a rear side insofar as items of jewellery can be placed over them and on the rear side resting against them free from hindrance onto the pins 26.

The radius r of the openings 16 is dimensioned so that two fingers of a user's hand, usually the thumb and the index finger, can conveniently place an item of jewellery onto the pin 26 and remove it again. The height H of the pin also plays a role for the convenience. The height H is dependent on the radius r of the opening 16 insofar as a smaller radius r means a smaller opening 16 and therefore less space for the fingers for placement of an item of jewellery. In this respect a relatively smaller height H of the pin 26 is more favourable, i.e. a height H which, for example, only corresponds to two thirds of the radius r. In the case of larger openings 16 on the other hand, the height H can correspond to the radius r or to about four thirds of its size.

FIG. 4 shows a perspective front view of a second embodiment of a jewellery board 2 according to the invention. This has a rectangular outline shape which has only four of the six sides of a rectangular prism, namely a rectangular front panel 40, a rectangular top panel 42 and two rectangular side panels 44. The front panel 40 is transversely oriented and contains five openings 16 located in one row R next to one another in the configuration described above for FIGS. 2 and 3. The top panel 42 has a groove 46 for the placement of smaller items at the top. At the bottom said panel has blind holes not shown for fastening the jewellery board 2 for example to screw hooks which are screwed into the wall. The side panels 44 then support the mounted jewellery board 2 or its front panel 40 with a spacing A from the wall so that on a rear side 48 of the front panel 40 a free space remains between the panel and the wall.

The jewellery board 2 can be operated largely identically to that of FIG. 1. The openings 16 allow a convenient placement of items of jewellery onto the pins 26 (FIG. 2) or their removal from the pins 26. The top panel 42 and the side panel 44 provide for the spacing A between the rear side 48 of the front panel 40 so that a rear side of the pins 26 is readily accessible in order to push items of jewellery thereover. The spacing A additionally provides for decorative bands, necklaces or the like to hang freely downwards so that they can remain without contact with the wall. Smaller items of jewellery, for example, ear studs, can be placed in the groove 46 at the top.

With a suitable namely overall larger dimensioning compared with the jewellery board 2, the device shown in FIG. 4 can also be used as a hanging device for textiles such as hand towels, tea cloths or bath towels or items of clothing such as coats, jackets, trousers, skirts or the like which have a separate hanger or one which can be used as such. For this purpose, merely the dimensions of the openings 16 and the pins 26, i.e. in particular the radius r (FIG. 2) of the opening 16 as well as proportionally the height H and the not designated thickness of the pin 26 need to be adapted, namely dimensioned to the larger user space required for less slender fingers and thicker hangers for textiles and to the usually greater weight of textiles.

FIG. 5 shows a perspective front view of a third embodiment of a jewellery board 3. It consists of an inclined rectangular front panel 50 and a base panel 52 which protrudes at a lower edge 54 from a rear side 56 of the front panel 50 so that this panel 50 and the base panel 52 yield an acute-angled L shape. The front panel 50 is consequently slightly inclined in the direction of the base panel 52 with the result that a free space exists on its rear side 56. The front panel 50 also has the openings 16 described above and specifically in three rows R one above the other. They lie in an upper section of the panel 50 so that a lower region 58 located thereunder remains free from openings. The jewellery board 3 can have different dimensions in the surface direction with the result that one or more openings 16 can be found in one or more rows R. They can cover the front panel 50, as shown over the partial area or also over the complete area. The jewellery board 3 is suitable as a stand-up display for example on a counter or in a shelf, for example, for the presentation of individual items of jewellery or a smaller collection of items of jewellery.

For this purpose, at least one visible surface 60 can be covered with velvet, for example, in order to give a higher-quality impression or a better contrast in particular on the lower opening-free region 58 to the presented items of jewellery.

FIG. 6 shows two embodiments for hanging aids 4, 5. They each comprise a ring portion 70, 72 with which they can be placed like an item of jewellery on the pins 26 of an opening 16 (FIG. 2). The ring portion 70, 72 is adjoined in each case by a hook portion 74, 76 which protrudes at an angle from the plane of extension of the respective ring portion 70, 72. Smaller items of jewellery can be hung on the hook portion 74, 76 which are too small for placing onto the pins 26. Thus, very small items of jewellery can be attached to the jewellery boards 1, 2, 3 without needing to place them in the grooves 20, 46.

Since the jewellery boards previously described in detail comprise exemplary embodiments, they can be modified in the usual manner by the person skilled in the art in wide scope without departing from the range of the invention. In particular, specific configurations of the openings and the outline shapes of the jewellery board can be accomplished in a different form to that described here. The arrangement of the openings can also be configured in a different form if this is necessary for reasons of space or design reasons. Furthermore the use of the indefinite article "a" or "an" does not exclude the fact that the relevant features can be present several times or multiple times.

REFERENCE LIST

1, 2, 3 Jewellery board
4, 5 Hanging aid
10 Rectangular board
12 First flange
14 Second flange
16 Opening
18 Rear side
20 Groove
22 Strip
24 Outline
26 Pin
28 Head
30 Rounding
32 Notch
40 Front panel
42 Top panel
44 Side panel
46 Groove
48 Rear side
50 Inclined rectangular front panel
52 Base panel
54 Lower edge
56 Rear side
58 Lower region
60 Visible surface
70, 72 Ring portion
74, 76 Hook portion
A Spacing
a Spacing
H Height
R Row
r Radius

The invention claimed is:

1. A board for arranging and storing items of jewellery, comprising:

a main board portion;

cutouts each of which penetrates through the main board portion with a retainer integrated therein for detachable fastening of the respective items of jewellery to the board, the retainer being a pin-shaped projection that projects upwards into the cutout in the lower region of each cutout, so that each of the cutouts opens an operating space around the retainer for attaching or detaching items of jewellery, a spacer for maintaining a free space on a rear side of the board at least in the region of the cutouts, and an inclining device for producing an inclination in the vertical direction, when the board is suspended, wherein the board has a fastener on an upper edge of the board, the fastener fastening or supporting the board on a wall.

2. The board according to claim 1, wherein the fastener is a flange.

3. The board according to claim 2, wherein the flange has blind holes on an underside of the flange.

4. The board according to claim 1, wherein one angular strip is positioned on each of an upper edge and a lower edge, which project from an extension plane of the main board portion towards different sides.

5. The board according to claim 1, wherein the cutouts are arranged above one another and/or next to one another in horizontal and/or vertical rows.

6. The board according to claim 1, wherein the cutouts have a circular boundary.

7. The board according to claim 1, wherein the cutouts have the same shape.

8. The board according to claim 7, wherein the cutouts of the board are identical.

9. The board according to claim 1, wherein the retainer is integral with the main board portion.

10. The board according to claim 1, wherein a notch is incorporated into the retainer on the rear side.

11. The board according to claim 10, wherein the notch is a horizontal groove.

12. The board according to claim 1, wherein the pin-shaped projection extends up to a maximum of up to two thirds the height of a respective cutout.

13. The board according to claim 1, comprising a separately configured suspension aid for jewellery which is configured to be placed onto one of the retainers, and which comprises a ring portion for placing the suspension aid onto the retainer and a hook section for suspending jewellery.

14. The board according to claim 1, configured as a suspension device for textiles.

15. The board according to claim 1, wherein the pin-shaped projection is a T-shaped pin-shaped projection that lies in a plane of the main board portion.

16. A board for arranging and storing items of jewellery, comprising:

a main board portion;

cutouts each of which penetrates through the main board portion with a retainer integrated therein for detachable fastening of the respective items of jewellery to the board, the retainer being a pin-shaped projection that projects upwards into the cutout in the lower region of each cutout, so that each of the cutouts opens an operating space around the retainer for attaching or detaching items of jewellery, a spacer for maintaining a free space on a rear side of the board at least in the region of the cutouts, and an inclining device for producing an inclination in the vertical direction, when the board is suspended, wherein the inclining device has the inclination such that a front side of the main board portion is inclined towards a user from an underside to an upper side of the main board portion.

17. The board according to claim 16, wherein the inclining device includes a first flange that protrudes towards a back side of the main board portion at a top of the main board portion at an angle of less than 90 degrees with respect to the main board portion, and a second flange that protrudes toward a front side of the board at a bottom of the board at an angle less than 90 degrees with respect to the main board portion.

18. The board according to claim 16, wherein the pin-shaped projection is a T-shaped pin-shaped projection that lies in a plane of the main board portion.

19. A board for arranging and storing items of jewellery, comprising:

a main board portion;

cutouts each of which penetrates through the main board portion with a retainer integrated therein for detachable fastening of the respective items of jewellery to the board, the retainer being a pin-shaped projection that projects upwards into the cutout in the lower region of each cutout, so that each of the cutouts opens an operating space around the retainer for attaching or detaching items of jewellery, a spacer for maintaining a free space on a rear side of the board at least in the region of the cutouts, and an inclining device for producing an inclination in the vertical direction, when the board is suspended, wherein the pin-shaped projection extends less than half of a height of the respective cutout.

* * * * *